United States Patent [19]

Meeks et al.

[11] Patent Number: 5,030,485

[45] Date of Patent: Jul. 9, 1991

[54] PAINTED DECOR MACRAME

[76] Inventors: Roland Meeks, 1591 S. Lane Ave. 39T, Jacksonville, Fla. 32210; George Spector, 233 Broadway RM 3815, New York, N.Y. 10007

[21] Appl. No.: 527,380

[22] Filed: May 23, 1990

[51] Int. Cl.[5] ..... G09F 19/02; G10F 1/06

[52] U.S. Cl. ..... 428/7; 40/430; 40/455; 428/16

[58] Field of Search ..... 40/430, 455; 428/7, 428/16

[56] References Cited

U.S. PATENT DOCUMENTS

| | | | |
|---|---|---|---|
| 1,512,283 | 10/1924 | Fritsche | 428/16 X |
| 1,928,573 | 9/1933 | Saeder | 40/417 |
| 2,770,918 | 11/1956 | Polk | 40/417 |
| 2,846,798 | 8/1958 | Polk | 40/417 |
| 3,308,705 | 3/1967 | Shinnick | 428/7 X |
| 3,905,140 | 9/1975 | Damiano | 40/455 X |
| 4,050,342 | 9/1977 | Suzuki et al. | 428/16 X |
| 4,240,218 | 12/1980 | Kotzin | 40/430 X |

*Primary Examiner*—Henry F. Epstein

[57] ABSTRACT

A decorative hanging device is provided and consists of a plurality of suspension members secured to and projecting from the top portion of a basket frame structure so as to be hung from a ceiling or the like. A plurality of silk flowers are arranged about a macrame fabric structure which covers the basket frame structure. Decor paint is applied to the macrame fabric structure so as to make an aesthetically pleasing structure.

4 Claims, 1 Drawing Sheet

PAINTED DECOR MACRAME

BACKGROUND OF THE INVENTION

The instant invention relates generally to decorative suspension hangers and more specifically it relates to a decorative hanging device which provides an aesthetically pleasing structure that is hug from a ceiling.

There are available various conventional decorative suspension hangers which do not provide the novel improvements of the invention herein disclosed.

SUMMARY OF THE INVENTION

A primary object of the present invention is to provide a decorative hanging device that will overcome the shortcomings of the prior art devices.

Another object is to provide a decorative hanging device that is suspended from a ceiling or the like which is asthetically pleasing to the eyes of a person.

An additional object is to provide a decorative hanging device that has a mechanism to produce music and movable artificial birds therein.

A further object is to provide a decorative hanging device that is simple and easy to use.

A still further object is to provide a decorative hanging device that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
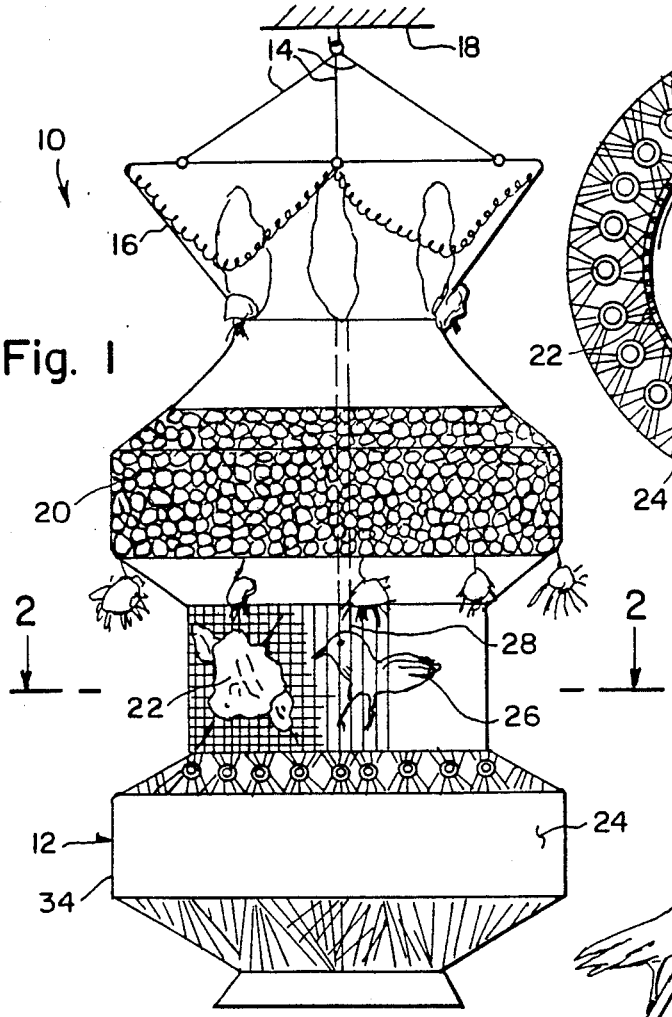
FIG. 1 is an elevational view of the invention.
Figure 2:
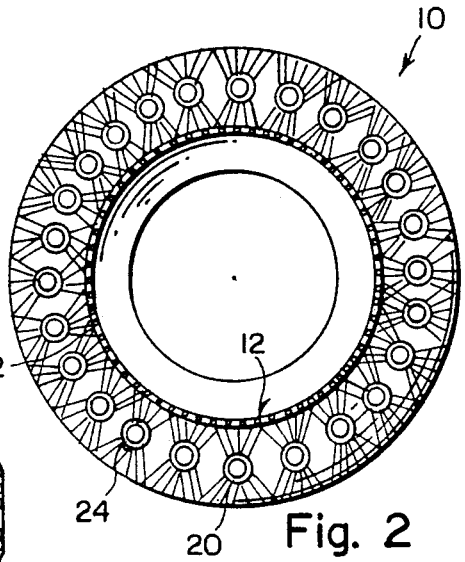
FIG. 2 is a cross sectional view taken along line 2—2 in FIG. 1.

Turning now descriptively to the drawings, in which similar reference characters denote similar elements throughout the several views, FIGS. 1 and 2 illustrate a decorative hanging device 10 consisting of a basket frame structure 12 with a plurality of suspension members 14 secured to and projecting from the top portion 16 of the basket frame structure 12 so as to be hung from a ceiling 18 or the like. A macrame fabric structure 20 covers the basket frame structure 12 while a plurality of silk flowers 22 are arranged about the macrame fabric structure. Decor paint 24 is applied to the macrame fabric structure 20 so as to make an asthetically pleasing structure. At least one artificial bird 26 is suspended by a thin satin ribbon 28 from the top portion 16 within the basket frame structure 12 so that the basket frame structure simulates a bird cage.

Figure 3:
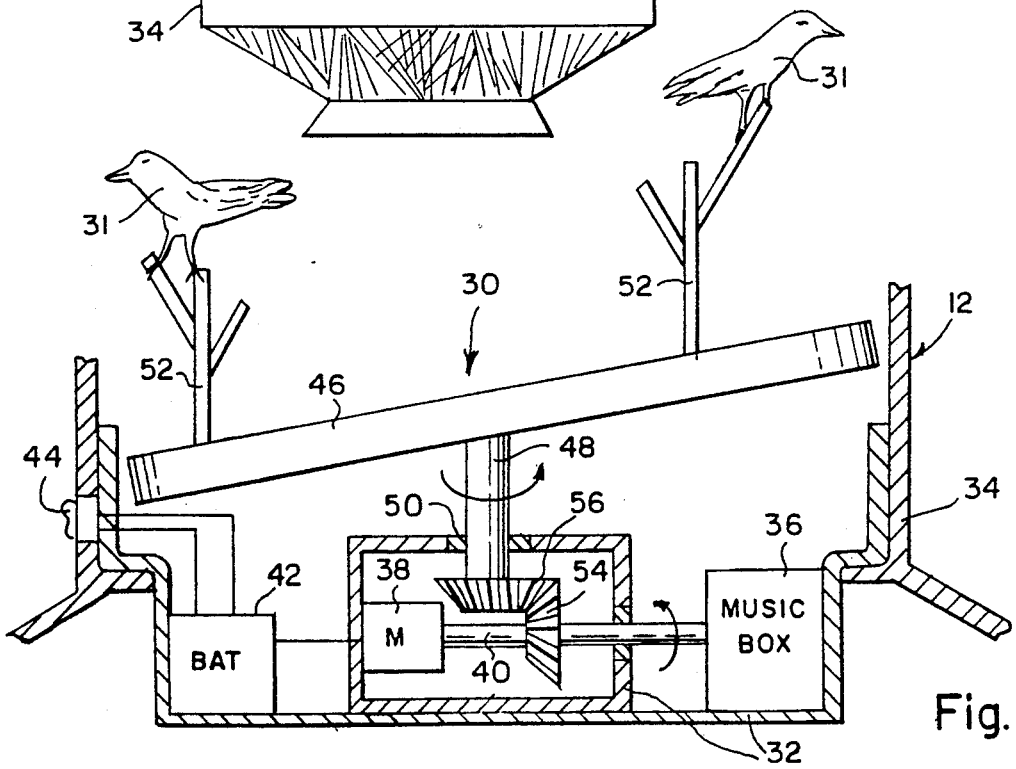
FIG. 3 is a modification being a diagrammatic vertical cross sectional view through the basket frame structure showing a mechanism to provide music and movable artificial birds therein.

As shown in FIG. 3, an assembly 30 is provided for making music and move artificial birds 31 within the basket frame structure 12. The assembly 30 includes a housing 32 supported within the bottom portion 34 of the basket frame structure 12. A music box 36 is carried within the housing 32 and an electric motor 38 is also carried within the housing 32 having a drive shaft 40 coupled to the music box 36. A battery 42 is carried within the housing 32 and is electrically connected to the motor 38. A switch 44 is disposed on the basket frame structure 12 and is electrically connected to the battery 42 so as to turn the motor 38 on and off. A tilted platform 46 has a vertical shaft 48 rotatably supported by a bearing 50 within the housing 32. Bird perches 52 with the artificial birds 31 thereon are supported on the tilted platform 46. A bevel gear 54 is affixed to the drive shaft 40 of the motor 38 while another bevel gear 56 is affixed to the distal end of the vertical shaft 48 of the tilted platform 36. The bevel gear 56 is in engagement with the bevel gear 54 so that the motor 38 will operate the music box 36 and rotate the tilted platform 46 in which the bird perches 52 with the artificial birds 31 thereon will make contact with the suspended artificial bird 26 within the basket frame structure 12 when the tilted platform 46 rotates.

The artificial birds 26 and 31 can be stuffed to hold potpourri therein to act as an air freshener. The macrame fabric structure 20 can be spray painted with the decor paint 24 in various colors while the silk flowers 22 can be in various arrangements therein. The device 10 is very lightweight and colorful. Since no watering or sunlight is required it is maintenance free and with proper care it can last a life time.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A decorative hanging device comprising:

a) a basket frame structure;

b) a plurality of suspension members secured to and projecting from a top portion of said basket frame structure so as to be hung from a ceiling;

c) a macrame fabric structure covering said basket frame structure;

d) a plurality of silk flowers arranged about an internally visible cage portion of said structure;

e) decor paint applied to said macrame fabric structure so as to make an asthetically pleasing structure and f) at least one artificial bird suspended in said cage portion so that said basket frame structure simulates a bird cage.

2. A decorative hanging device as recited in claim 1, further including means for simultaneously providing music and moving artificial birds to different positions within said cage portion.

3. A device as recited in claim 2, wherein said means includes a mechanism for moving spaced birds rotatably and vertically in conjunction with gererating music.

4. A decorative hanging device as recited in claim 2, wherein said mechanism includes:

a) a housing supported within a bottom portion of said basket frame structure;

b) a music box carried within said housing;

c) an electric motor carried within said housing and having a drive shaft coupled to said music box;

d) a battery carried within said housing electrically connected to said motor;

e) a switch disposed on said basket frame structure and electrically connected to said battery so as to turn said motor on and off;

f) a tilted platform having a vertical shaft rotatably supported within said housing;

g) at least one bird perch with an artificial bird thereon supported on said tilted platform;

h) a first bevel gear affixed to the drive shaft of said motor; and i) a second bevel gear affixed to the distal end of the vertical shaft of said tilted platform, whereby said second bevel gear is in engagement with said first bevel gear so that said motor will operate said music box and rotate said tilted platform in which said at least one bird perch with the artificial bird thereon will make contact with said suspended artificial bird within said basket frame structure when said tilted platform rotates.

* * * * *